US006707920B2

(12) United States Patent
Miller

(10) Patent No.: US 6,707,920 B2
(45) Date of Patent: Mar. 16, 2004

(54) IMPLANTABLE HEARING AID MICROPHONE

(75) Inventor: Douglas Alan Miller, Lafayette, CO (US)

(73) Assignee: Otologics LLC, Boulder, CO (US)

( * ) Notice: Subject to any disclaimer, the term of this patent is extended or adjusted under 35 U.S.C. 154(b) by 112 days.

(21) Appl. No.: 09/734,964

(22) Filed: Dec. 12, 2000

(65) Prior Publication Data

US 2002/0071585 A1 Jun. 13, 2002

(51) Int. Cl.[7] ..... H04R 25/00
(52) U.S. Cl. ..... 381/326; 381/355; 600/25
(58) Field of Search ..... 381/170, 191, 381/355, 359–361, 369, 326, 380, 151; 181/158, 161, 163; 600/25; 607/56, 57

(56) References Cited

U.S. PATENT DOCUMENTS 4,443,666 A * 4/1984 Cote ..... 381/113
4,450,930 A * 5/1984 Killion ..... 181/129
4,504,703 A * 3/1985 Schneiter et al. ..... 181/163
4,532,930 A 8/1985 Crosby et al. ..... 128/419
4,606,329 A 8/1986 Hough ..... 128/1
4,607,383 A * 8/1986 Ingalls ..... 381/113
4,621,171 A * 11/1986 Wada et al. ..... 381/113
4,774,933 A 10/1988 Hough et al. ..... 600/25
4,815,560 A * 3/1989 Madaffari ..... 181/129
4,837,833 A * 6/1989 Madaffari ..... 181/129
RE33,170 E 2/1990 Byers ..... 128/419
4,932,405 A 6/1990 Peeters et al. ..... 128/419
4,936,305 A 6/1990 Ashtiani et al. ..... 128/420.6
5,015,224 A 5/1991 Maniglia ..... 600/25
5,105,811 A 4/1992 Kuzma ..... 128/420.6
5,163,957 A 11/1992 Sade et al. ..... 623/10
5,176,620 A 1/1993 Gilman ..... 600/25
5,277,694 A 1/1994 Leysieffer et al. ..... 600/25
5,363,452 A * 11/1994 Anderson ..... 381/170

(List continued on next page.)

*Primary Examiner*—Curtis Kuntz
*Assistant Examiner*—P. Dabney
(74) *Attorney, Agent, or Firm*—Marsh Fischmann & Breyfogle LLP

(57) ABSTRACT

An improved implantable hearing aid microphone comprises a housing having an internal chamber with an aperture thereto and a first diaphragm sealably positioned across the aperture. A microphone having a second diaphragm is positioned within the chamber to define an enclosed volume between the first and second diaphragms for mechanically amplifying acoustic signals received by the first diaphragm. A peripheral rim may define the aperture of the housing, wherein the first diaphragm may be recessed between about 0.5 mm and 1.0 mm relative to the peripheral rim across the lateral extent of the first diaphragm. The internal chamber may be defined to include a first portion having a first cross-sectional area adjacent to the first diaphragm, and a second portion having a second cross-sectional area adjacent to the second diaphragm that is smaller than the first cross-sectional area. The second portion may be disposed to extend away from the first portion about an axis that is transverse to the first diaphragm. In turn, the first diaphragm may be provided to have an effective cross-sectional area that is at least about 100 times greater than the effective cross-sectional area of the second diaphragm. In one arrangement, the second internal chamber portion may be of an L-shaped configuration with a first leg being coaxially aligned with a center axis of the first diaphragm and a second leg disposed substantially perpendicular thereto with the second diaphragm disposed therein. The first diaphragm may comprise a biocompatible material, such titanium or a titanium alloy. The first diaphragm may be provided to have a cross-width of between about 8 to 15 millimeters and a thickness of between about 10 and 20 microns.

42 Claims, 3 Drawing Sheets

U.S. PATENT DOCUMENTS 5,411,467 A 5/1995 Hortmann et al. ..... 600/25
5,456,654 A 10/1995 Ball ..... 600/25
5,554,096 A 9/1996 Ball ..... 600/25
5,558,618 A 9/1996 Maniglia ..... 600/25
5,624,376 A 4/1997 Ball et al. ..... 600/25
5,702,431 A 12/1997 Wang et al. ..... 607/61
5,749,912 A 5/1998 Zhang et al. ..... 607/57
5,762,583 A 6/1998 Adams et al. ..... 600/25
5,795,287 A 8/1998 Ball et al. ..... 600/25
5,800,336 A 9/1998 Ball et al. ..... 600/25
5,814,095 A 9/1998 Muller et al. ..... 607/57
5,842,967 A 12/1998 Kroll ..... 600/25
5,857,958 A 1/1999 Ball et al. ..... 600/25
5,859,916 A * 1/1999 Ball et al. ..... 381/326
5,881,158 A 3/1999 Lesinski et al. ..... 381/174
5,888,187 A 3/1999 Jaeger et al. ..... 600/25
5,897,486 A 4/1999 Ball et al. ..... 600/25
5,906,635 A 5/1999 Maniglia ..... 607/57
5,913,815 A 6/1999 Ball et al. ..... 600/25
5,951,601 A 9/1999 Lesinski et al. ..... 623/10

* cited by examiner

IMPLANTABLE HEARING AID MICROPHONE

FIELD OF THE INVENTION

The present invention related to the field of implantable hearing aid devices, and in particular, to implantable hearing aid microphones employable in fully- and semi-implantable hearing aid systems.

BACKGROUND OF THE INVENTION

Traditional hearing aids are placed in a user's ear canal. The devices function to receive and amplify acoustic signals within the ear canal to yield enhanced hearing. In some devices, "behind-the-ear" units have been utilized which comprise a microphone to transduce the acoustic input into an electrical signal, some type of signal processing circuitry to modify the signal appropriate to the individual hearing loss, an output transducer (commonly referred to in the field as a "receiver") to transduce the processed electrical signal back into acoustic energy, and a battery to supply power to the electrical components.

More recently, a number of different types of fully- or semi-implantable hearing aid devices have been proposed. By way of primary example, implantable devices include those which employ implanted electromechanical transducers for stimulation of the ossicular chain and/or oval window (see e.g., U.S. Pat. No. 5,702,342), and those which utilize implanted exciter coils to electromagnetically stimulate magnets fixed within the middle ear (see e.g., U.S. Pat. No. 5,897,486). In these as well as other implanted devices, acoustic signals are received by an implantable microphone, wherein the acoustic signal is converted to an electrical signal that is employed to drive an actuator that stimulates the ossicular chain and/or oval window.

As may be appreciated, such implantable hearing aid microphones must necessarily be positioned at a location that facilitates the receipt of acoustic signals and effective signal conversion/transmission to an implanted actuator. For such purposes, implantable hearing aid microphones are most typically positioned in a surgical procedure between a patient's skull and skin, at a location rearward and upward of a patient's ear (e.g., in the mastoid region).

Given such positioning, the size and ease of installation of implantable hearing aid microphones are primary considerations in the further development and acceptance of implantable hearing aid systems. Further, due to the subcutaneous location of implantable hearing aid microphones, it is important that effective and efficient amplification be provided to yield a high fidelity signal. Relatedly, the componentry cost of providing such amplification is of importance to achieving widespread use of implantable system. Finally, it is important that the overall design of implantable microphones mitigate servicing/replacement needs.

SUMMARY OF THE INVENTION

In view of the foregoing, a primary objective of the present invention is to provide an implantable hearing aid microphone having a relatively small profile, particularly in the lateral extent.

Another objective of the present invention is to provide an implantable hearing aid microphone that reduces the extent of exposed surfaces for tissue attachment/infiltration, thereby reducing the potential need/periodicity of microphone servicing/replacement.

An additional objective of the present invention is to provide an implantable hearing aid microphone that is reliable and cost effective.

Yet further objectives of the present invention are to provide an implantable hearing aid microphone that is relatively robust and that provides for effective and efficient acoustic signal conversion to yield a high fidelity signal for middle ear stimulation.

One or more of the above objectives and additional advantages are realized in the implantable hearing aid microphone apparatus comprising the present invention. Such apparatus includes a housing having an internal chamber with an aperture thereto defined by a peripheral rim surrounding the aperture. A first diaphragm is sealably positioned across the aperture. Additionally, a microphone having a second diaphragm is disposed within the internal chamber to define an enclosed volume between the first and second diaphragms for mechanically amplifying acoustic signals received by the first diaphragm.

In one aspect of the present invention, the first diaphragm is recessed relative to the peripheral rim surrounding the aperture. More particularly, the first diaphragm may be preferably recessed between about 0.5 mm and 1.0 mm relative to the peripheral rim of the housing and across the lateral extent of the first diaphragm. Further, the outer edge of the peripheral rim may be disposed in a first plane and at least an outer face of the first diaphragm may be flat and disposed in parallel relation to the first plane.

In another aspect of the present invention, the internal chamber may be defined to comprise at least a first portion having a first cross-sectional area adjacent to the first diaphragm, and a second portion extending away from the first portion about an axis transfer to the aperture and/or first diaphragm and having a second cross-sectional area adjacent to the second diaphragm. Preferably, the first cross-sectional area is greater than the second-sectional area. Relatedly, it is preferable that the first diaphragm having an effective cross-sectional area (i.e., the area exposed for receipt of acoustic signals) that is at least about 100 times greater than the effective cross-sectional area of the second diaphragm.

The second portion of the internal chamber may adjoin the first portion internal chamber at a reduced opening therebetween, wherein the opening is smaller than and is positioned in opposing relation to the aperture. Further, the aperture and the opening may be coaxially aligned and may each be of circular configuration.

In one arrangement, the second portion of the internal chamber may be of an L-shaped configuration, wherein an opening between the first and second portions of the internal chamber is located at an end of a first leg of the second portion. In turn, the second diaphragm is positioned in a second leg of the second portion. Preferably, both the first and second legs of the second internal chamber portion, as well as the first internal chamber portion may, each be of a cylindrical configuration. Further, the first and second legs of the L-shaped second internal chamber portion may adjoin an internally rounded elbow.

In yet another aspect of the present invention, the first diaphragm may comprise a biocompatible material. By way of primary example, the first diaphragm may comprise a material selected from a group consisting of titanium and titanium-alloys. Further, it is preferable that the maximum cross-width of the first diaphragm (i.e., as measured across the area exposed for receipt of acoustic signals) established between about 8 and 15 millimeters, and most preferably between about 10–12 millimeters. Further, it is preferable that the first diaphragm thickness be established at between about 10 and 20 microns across the lateral extent thereof, and most preferably between about 12 and 15 microns.

By virtue of the above-noted features, an implantable microphone may be provided to reduce exposed surfaces for tissue infiltration. Further, a microphone may be constructed to reduce lateral space requirements upon surgical installation. Additionally, a microphone may be readily fabricated and assembled in a cost effective manner, while also yielding effective, high-quality signal amplification capabilities.

Additional aspects and advantages of the present invention will be apparent to those skilled in the art upon review of the further description that follows.

DETAILED DESCRIPTION

Figure 1:
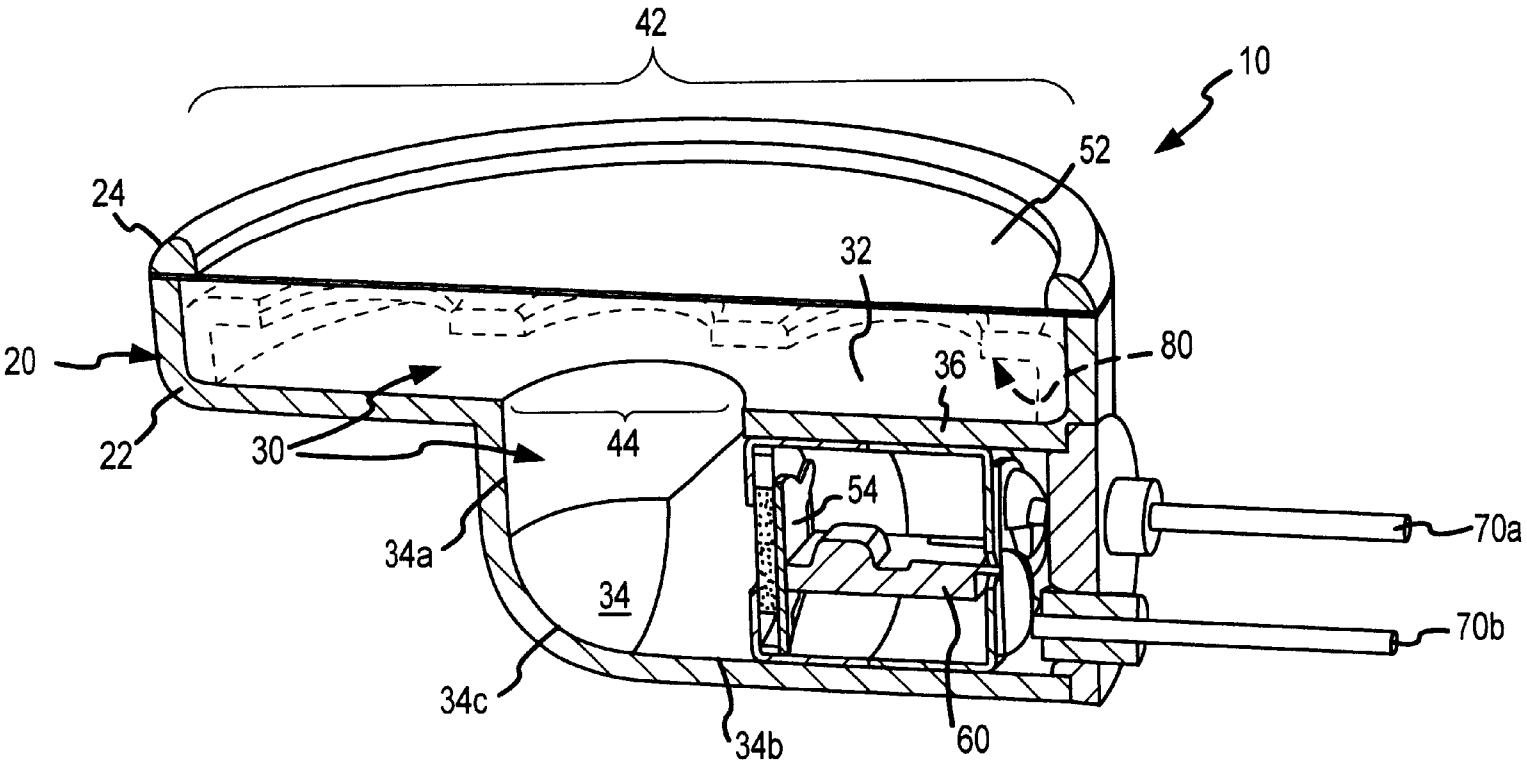
FIG. 1 is isometric, cross-sectional view of one embodiment of the present invention.
Figure 2B:
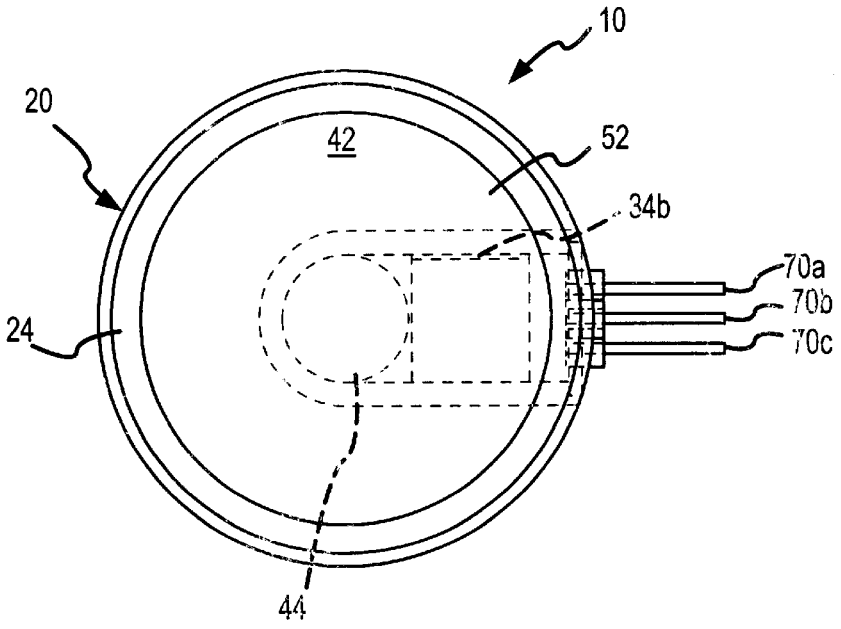
FIGS. 2A and 2B are cross-sectional and top views, respectively, of the embodiment shown in FIG. 1.
Figure 2A:
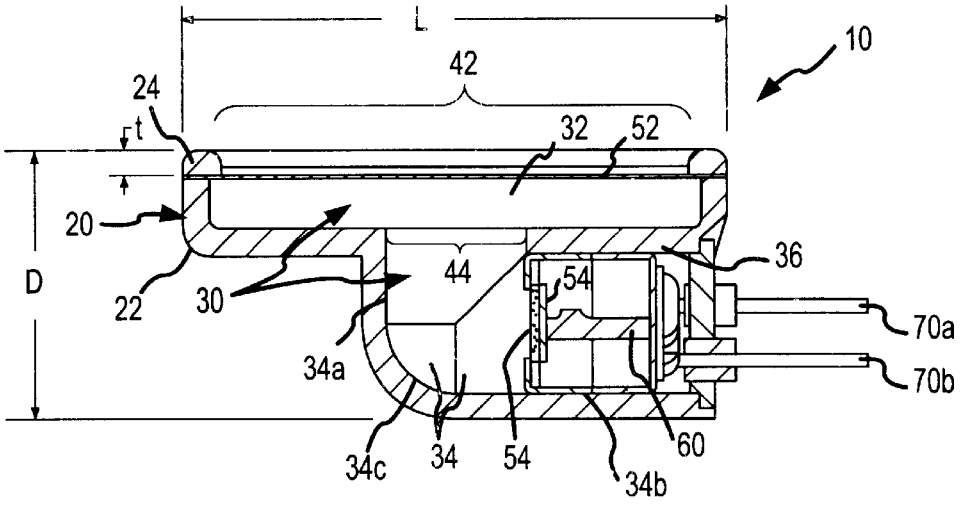

FIGS. 1, 2A and 2B illustrate one embodiment of an implantable hearing aid microphone comprising the present invention. The microphone embodiment 10 comprises a housing 20 that defines an internal chamber 30. The chamber 30 has an aperture 42 across which a first diaphragm 52 is sealably disposed. In the illustrated embodiment, housing 20 includes a base member 22 and a peripheral member 24 defining the aperture 42. The peripheral edge of the first diaphragm 52 is fixedly interconnected between the base member 22 and peripheral member 24 of the housing 20 (e.g., via laser welding).

As best shown by FIG. 2A, the first diaphragm 52 is recessed relative to the outer peripheral member 24. In this regard, it is preferable that the first diaphragm 52 be recessed a distance t relative to the outer rim of peripheral member 24, wherein preferably 0.5 mm<t<1.0 mm. Further, it is preferable that the outer, peripheral rim of the peripheral member 24 lie substantially within a first plane, and that at least an outer surface of the first diaphragm 52 be configured (i.e., flat) and positioned in a substantial parallel relationship to the first plane.

As illustrated in FIGS. 1 and 2A, internal chamber 30 may be provided to include a first portion 32 and a second portion 34. The first portion 32 is disposed adjacent to the first diaphragm 52. The second portion 34 adjoins and extends away from the first portion 32 at an opening 44 therebetween and about an axis that is transverse to the first diaphragm 52 and aperture 42. As shown, opening 44 may be of a reduced cross-sectional area relative to aperture 42.

In the microphone embodiment 10, the second internal chamber portion 34 may be of L-shaped configuration, wherein the second portion 34 comprises a first leg 34*a* that extends away from the first internal chamber portion 32 about an axis that is substantially perpendicular to a center plane of the first diaphragm 52. The second internal chamber portion 34 further includes a second leg 34*b* interconnected to the first leg 34*a* at a rounded elbow 34*c*.

Aperture 42 and opening 44 may each be of a circular configuration and may each be aligned about a common center axis. Correspondingly, such common center axis may be aligned with a center axis for first diaphragm 52 which may also be of a circular shape. Further, the first internal chamber portion 32 and first leg 34*a* of the second internal chamber portion 34 may each be of a cylindrical configuration, and may each be aligned on the same center axis as aperture 42 and opening 44. The second leg 34*b* of the second portion 34 of chamber 32 may be disposed to extend substantially perpendicularly from the first leg 34*a* of the second portion 34. As such, it can be seen that the second leg 34*b* may share a wall portion 36 with the first portion 32 of the internal chamber 30.

As shown in FIGS. 1 and 2A, the above-noted second diaphragm 54 is disposed at the interface between the first leg 34*a* and second leg 34*b* of the second chamber portion 34. More particularly, the second diaphragm 54 may be provided at a port of a conventional hearing aid microphone 60 which is disposed within the second leg 34*b* of the second chamber portion 34. In this regard, conventional hearing aid microphone 60 may comprise an electret condenser microphone. By way of example, conventional hearing aid microphone 60 may comprise a microphone unit offered under the name Model FG, offered by Knowles Electronics of Itasca, Ill. In this regard, the second diaphragm 54 may be provided as part of the conventional hearing aid microphone 60. As may be appreciated, hearing aid microphone 60 may be provided with electrical power and control signals and may provide an electrical output signal, each of which signals are carried by corresponding signal lines 70*a*, 70*b* or 70*c*.

In use, the microphone embodiment 10 may be surgically implanted in the mastoid region of a patient, wherein the aperture 42 and the first diaphragm 52 are positioned immediately adjacent to and facing the skin of the patient. Upon receipt of an acoustic signal the first diaphragm 52 will vibrate to act upon the enclosed volume within chamber 30 and thereby mechanically amplify the acoustic signal as received by the second diaphragm 54. In this regard, it has been found that the effective cross-sectional area (i.e., the area exposed to the receipt of acoustic signals) of the first diaphragm 52 should be at least about 100 times greater than the effective cross-sectional area of the second diaphragm 54. Such one hundred-fold size differential provides for about 100 times amplification of acoustic signals (40 dB), thereby compensating for the attenuation associated with acoustic signal passage through a patient's skin tissue.

Upon receipt of the acoustic signals at the second diaphragm 54, the conventionally microphone device 60 will convert the mechanical acoustic signal into an electrical signal for output via one of the signal lines 70*a*, 70*b* or 70*c*. In turn, such output signal may be further conditioned and/or directly transmitted to an internal hearing aid actuator device that stimulates the ossicular chain and/or tympanic membrane. In one approach, the output signal may be provided to an electromechanical transducer having a probe positioned to mechanically stimulate the incus.

The housing 20 and first diaphragm 52 are preferably constructed from biocompatible materials. In particular, titanium and/or biocompatible titanium-containing alloys may be utilized for the construction of such components. With particular respect to the first diaphragm 52 it is preferable that the material utilized and thickness thereof be established to yield resonant frequency above about 8 kHz when mechanically loaded by tissue, wherein the resonance preferably has no greater than about a 20 dB excursion. Further, attenuation effects of the first diaphragm 52 are preferably no more than 10 dB from about 250 Hz to 5.5 kHz. By way of example, first diaphragm 52 may comprise titanium, and may be of a flat, disk-shaped configuration having a thickness of between about 10 and 20 microns, and most preferably between about 12 and 15 microns.

Figure 3B:
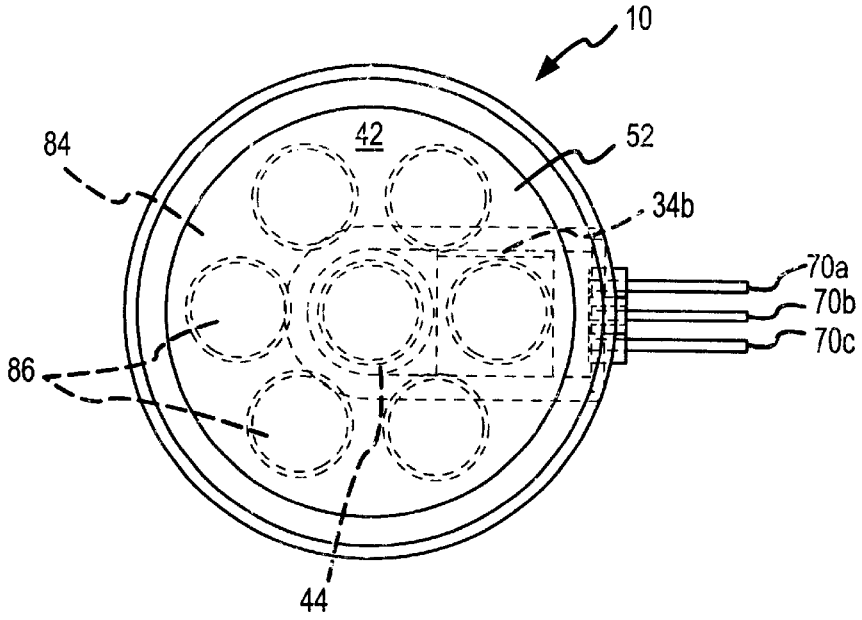
FIGS. 3A and 3B are cross-sectional and top views, respectively, of an alternate embodiment of the present invention.
Figure 3A:
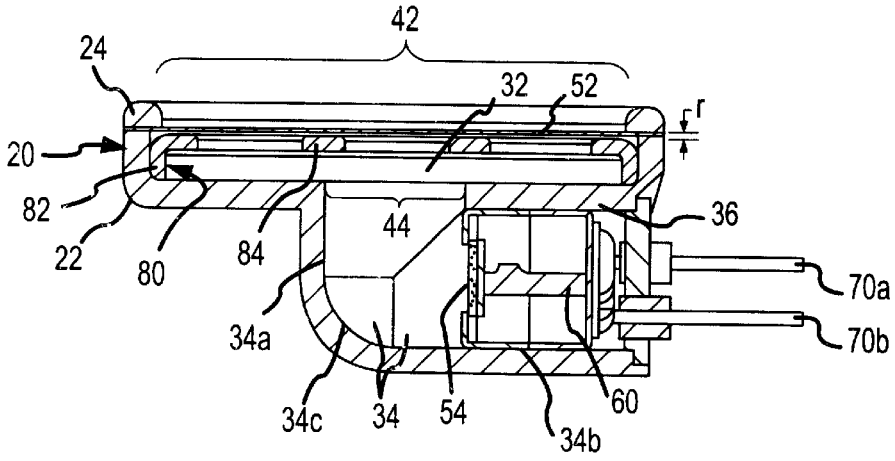

Referring again now to FIG. 1 as well as FIGS. 3A and 3B, optional features that may be employed in conjunction with the present invention are illustrated. In particular, FIG. 1 illustrates in phantom lines the inclusion of a support member 80 that is located within the first portion 32 of the internal chamber 30 of housing 20. As illustrated, the support member 80 may include a cylindrical, peripheral flange 82 as well as a support plate 84. The peripheral flange 82 may be interconnected to the internal cylindrical surface of the base member 22 (e.g., via laser welding).

The support plate 84 is positioned to be spaced a predetermined distance r away from a back surface of a first diaphragm 52. In this regard, the opposing surface of plate member 84 and first diaphragm may each be substantially flat and disposed in parallel relation. Preferably, distance r is between about 1.0 and 5.0 microns. In order to provide for the passage of acoustic signals therethrough, the support plate 84 may comprise a number of apertures 86, including a central aperture coaxially aligned with aperture 42 and opening 44. In use, the support member 80 provides a mechanism to limit over-deflection of the first diaphragm 52.

The embodiments described above are for exemplary purposes only and are not intended to limit the scope of the present invention. Various adaptations, modifications and extensions will be apparent to one skilled in the art and are intended to be within the scope of the invention as defined by claims which follow.

What is claimed:

1. An implantable hearing aid microphone apparatus comprising:

a housing having an internal chamber with an aperture thereto and a peripheral rim surrounding the aperture, wherein said internal chamber includes a first portion adjacent to said aperture and a second portion adjoining said first portion at an opening therebetween, wherein said opening is smaller than said aperture, and wherein said second portion extends away from the first portion about an axis transverse to said aperture;

a first diaphragm sealably positioned across said aperture and recessed relative to said peripheral rim; and a microphone having a second diaphragm located adjacent to said second portion of said chamber and in non-parallel relation to said first diaphragm, wherein an enclosed volume is defined between said first and second diaphragms.

2. An apparatus as recited in claim 1, wherein said first diaphragm is recessed between about 0.5 mm and 1.0 mm relative to said peripheral rim across the lateral extent of said first diaphragm.

3. An apparatus as recited in claim 2, wherein an outer surface of said first diaphragm is substantially parallel to said peripheral rim.

4. An apparatus as recited in claim 1, wherein said first portion of said internal chamber has a first cross-sectional area and said second portion of said internal chamber has a second cross-sectional area, and wherein said first cross-sectional area is greater than said second cross-sectional area.

5. An apparatus as recited in claim 4, wherein said axis is substantially perpendicular to said first diaphragm.

6. An apparatus as recited in claim 5, wherein said first and second portions are coaxially centered about said axis.

7. An apparatus as recited in claim 1, wherein said first diaphragm has an effective cross-sectional area at least about 100 times greater than an effective cross-sectional area of said second diaphragm.

8. An apparatus as recited in claim 1, wherein said second portion adjoins said first portion only at said opening therebetween.

9. An apparatus as recited in claim 8, wherein said opening is positioned in opposing relation to said aperture.

10. An apparatus as recited in claim 9, wherein said aperture and said opening are coaxially aligned.

11. An apparatus as recited in claim 10, wherein said aperture and said opening are each of a circular configuration.

12. An apparatus as recited in claim 9, wherein said second portion is of an L-shaped configuration, wherein said opening is located at the end of a first leg of said second portion and said second diaphragm is positioned in a second leg of said L-shaped second portion.

13. An apparatus as recited in claim 12, wherein said first portion of said chamber is of a cylindrical configuration, and wherein each of said first leg and said second leg of said second portion of said chamber are each of a cylindrical configuration.

14. An apparatus as recited in claim 12, wherein said first portion of said chamber and said first leg of said second portion of said chamber are coaxially aligned.

15. An apparatus as recited in claim 13, wherein said first leg and said second leg of said second portion of said internal chamber adjoin at a rounded elbow.

16. An apparatus as recited in claim 1, further comprising:

a support member positioned within said chamber at a predetermined distance from an internal surface of said first diaphragm.

17. An apparatus as recited in claim 16, wherein said predetermined distance is between about 1.0 and 5.0 microns.

18. An apparatus as recited in claim 1, wherein said housing and said first diaphragm comprise a biocompatible material.

19. An apparatus as recited in claim 18, wherein said biocompatible material comprises titanium.

20. An apparatus as recited in claim 1, wherein said first diaphragm has a maximum cross-width of between about 8 and 15 millimeters.

21. An apparatus as recited in claim 20, wherein said first diaphragm has a thickness of between about 10 and 20 microns across the lateral extent thereof.

22. An implantable hearing aid microphone apparatus comprising:

a housing having an internal chamber with an aperture thereto, said internal chamber including a first portion and a second portion adjoining said first portion at an opening therebetween, wherein said opening is smaller than said aperture, and wherein said second portion extends away from the first portion about an axis transverse to said aperture;

a first diaphragm sealably positioned across said aperture; and, a microphone having a second diaphragm located adjacent to said second portion of said internal chamber and in non-parallel relation to said first diaphragm, wherein an enclosed volume is defined between the first and second diaphragms.

23. An apparatus as recited in claim 22, wherein said first diaphragm has an effective cross-sectional area at least about 100 times greater than an effective cross-sectional area of the second diaphragm.

24. An apparatus as recited in claim 22, wherein said opening is positioned in opposing relation to said aperture.

25. An apparatus as recited in claim 24, wherein said aperture and said opening are coaxially aligned.

26. An apparatus as recited in claim 25, wherein said second portion of said internal chamber is of an L-shaped configuration, and wherein said opening is located at an end of a first leg of said second portion and said second diaphragm is positioned in a second leg of said second portion.

27. An implantable hearing aid microphone apparatus comprising;

an internal chamber with an aperture thereto, said internal chamber having a first portion adjacent to said aperture and a second portion adjoining said first portion at an opening therebetween, wherein said opening is smaller than said aperture and wherein said second portion extends away from the first portion about an axis transverse said aperture;

a first diaphragm sealably positioned across said aperture; and, a second diaphragm located adjacent to said second portion of said internal chamber and in non-parallel relation to said first diaphragm, wherein an enclosed volume is defined between the first and second diaphragms.

28. An apparatus as recited in claim 27, wherein said first portion of said internal chamber has a first cross-sectional area and said second portion of said internal chamber has a second cross-sectional area, and wherein said first cross-sectional area is greater than said second cross-sectional area.

29. An apparatus as recited in claim 27, wherein said axis is substantially perpendicular to said first diaphragm.

30. An apparatus as recited in claim 29, wherein said first and second portions are coaxially centered about said axis.

31. An apparatus as recited in claim 30, wherein said opening is positioned in opposing relation to said aperture.

32. An apparatus as recited in claim 27, wherein said first and second portions are coaxially centered about said axis.

33. An apparatus as recited in claim 32, wherein said opening is positioned in opposing relation to said aperture.

34. An apparatus as recited in claim 27, wherein said opening is positioned in opposing relation to said aperture.

35. An apparatus as recited in claim 34, wherein said aperture and said opening are each of a circular configuration.

36. An apparatus as recited in claim 34, wherein said aperture and said opening are coaxially aligned.

37. An apparatus as recited in claim 36, wherein said aperture and said opening are each of a circular configuration.

38. An apparatus as recited in claim 36, wherein said axis coincides with a common center axis for each of said first and second portions, said opening and said aperture.

39. An apparatus as recited in claim 36, wherein said second diaphragm is disposed in substantially parallel relation to said axis.

40. An apparatus as recited in claim 34, wherein said first and second portions of said internal chamber are adjoined only at said opening therebetween.

41. An apparatus as recited in claim 27, wherein said second diaphragm is disposed in substantially parallel relation to said axis.

42. An apparatus as recited in claim 41, wherein said second diaphragm is spaced from said axis a distance that substantially corresponds with a radius of said opening.

* * * * *